United States Patent [19]

Lapham

[11] Patent Number: 4,744,461

[45] Date of Patent: May 17, 1988

[54] CARRYING CASE FOR EYEGLASSES

[75] Inventor: Ralph R. Lapham, New London, N.H.

[73] Assignee: Uvex Winter Optical, Inc., North Smithfield, R.I.

[21] Appl. No.: 27,259

[22] Filed: Feb. 20, 1987

[51] Int. Cl.[4] ..... A45C 11/04

[52] U.S. Cl. ..... 206/5; 220/4 B

[58] Field of Search ..... 206/5, 6, 530; 220/4 B, 220/8

[56] References Cited

U.S. PATENT DOCUMENTS

| | | | |
|---|---|---|---|
| D. 258,762 | 3/1981 | Corrigan et al. | 220/8 X |
| 2,718,980 | 9/1955 | Strom | 220/8 X |
| 2,903,125 | 9/1959 | Levoy | 206/5 |
| 3,038,593 | 6/1962 | Root et al. | 206/5 |
| 4,534,467 | 8/1985 | Rathbun | 206/530 |

FOREIGN PATENT DOCUMENTS

| | | | |
|---|---|---|---|
| 682486 | 11/1966 | Belgium | 220/4 B |
| 1058566 | 7/1979 | Canada | 206/530 |
| 2431672 | 1/1976 | Fed. Rep. of Germany | 206/8 |
| 2526283 | 11/1983 | France | 206/6 |

*Primary Examiner*—William Price

*Attorney, Agent, or Firm*—Salter & Michaelson

[57] ABSTRACT

A carrying case for eyeglasses comprises a substantially cylindrical capsule including releasably connected first and second capsule sections, and a carrying strap on one of the capsule sections. The capsule is dimensioned for receiving and containing a pair of eyeglasses so that the eyeglasses are prevented from moving significant amounts either laterally or longitudinally therein and as a result the lenses of the eyeglasses are prevented from contacting the inner wall of the capsule. The capsule is preferably further constructed so that it is waterproof and so that it has sufficient buoyancy to cause the case to float on water, even when a pair of eyeglasses is contained in the capsule.

12 Claims, 1 Drawing Sheet

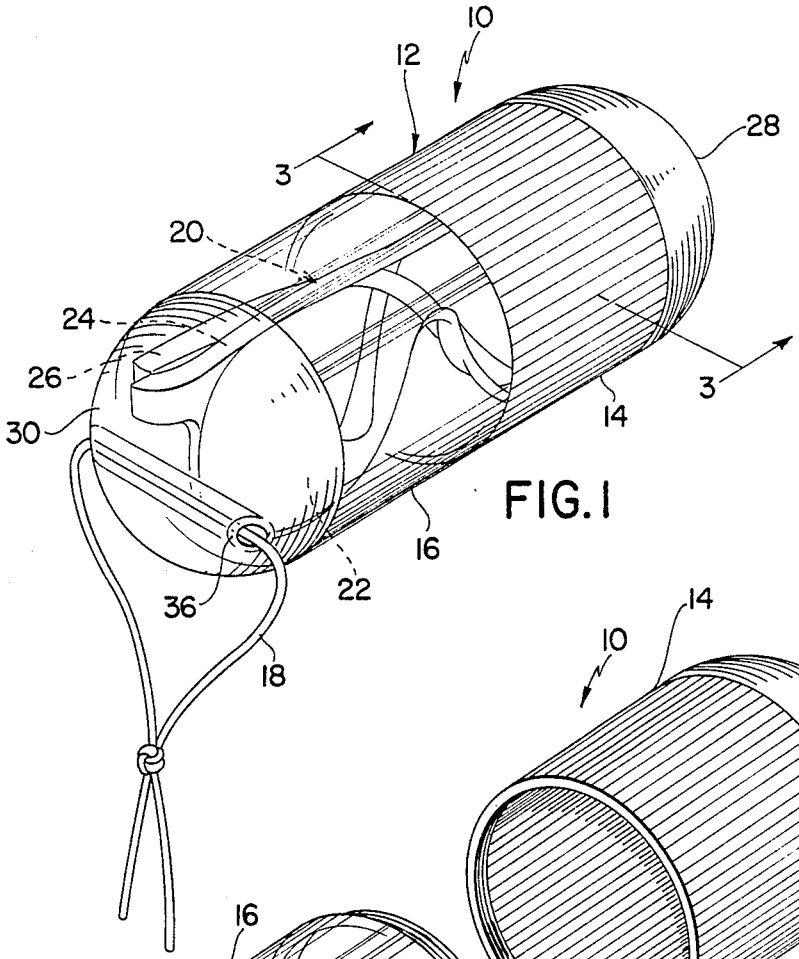
FIG. 1
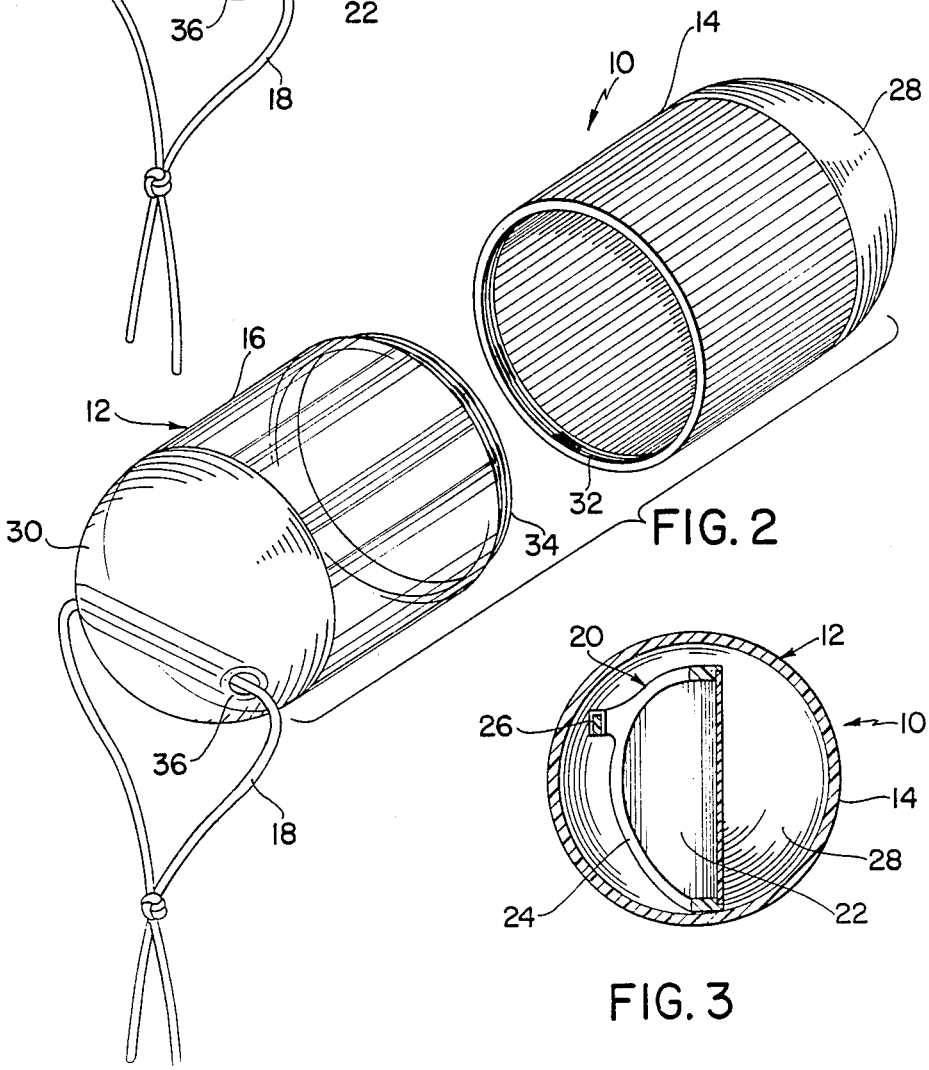
FIG. 2
FIG. 3

CARRYING CASE FOR EYEGLASSES

BACKGROUND AND SUMMARY OF THE INVENTION

The instant invention relates to equipment used in connection with eyeglasses and more particularly to a novel carrying case for a pair of eyeglasses.

Various types of carrying cases have been heretofore available for use in transporting and protecting eye wear. For example, protective cases comprising elongated pockets made of various types of rigid and/or flexible materials have been heretofore available for many years for containing eyeglasses so that they are protected when not in use. Other types of carrying case constructions comprising various types of rigid shell-like casings, some of which have rigid hingeable cover portions, have also been heretofore available. In this connection, the U.S. patent to ANDERSON, U.S. Pat. No. 2,809,766, discloses a carrying case which is exemplary of one type of rigid carrying case which has been heretofore available for protecting eyeglasses when they are not in use. Other types of carrying cases for eyeglasses and other articles which together with the aforementioned U.S. patent to ANDERSON represent the closest prior art to the subject invention of which the applicant is aware are disclosed in the U.S. patents to GRAY, U.S. Pat. No. Des. 259,596; ANEMA, U.S. Pat. No. Des. 262,585; BROWN U.S. Pat. No. 1,205,510; KAUFMAN et al, U.S. Pat. No. 1,714,877; SULLIVAN, U.S. Pat. No. 2,371,557; HOOGESTEGER et al, U.S. Pat. No. 3,524,455; and LEVESQUE, U.S. Pat. No. 4,393,974. However, none of these patents suggest a carrying case for eyeglasses comprising a cylindrical capsule, wherein a pair of eyeglasses is receivable in the capsule for protecting the eyeglasses; and hence they are believed to be of only general interest with respect to the subject invention.

The carrying case of the instant invention generally comprises a substantially cylindrical capsule which includes releasably connected first and second capsule sections, and which is adapted for receiving a pair of eyeglasses in a collapsed disposition therein. More specifically, the carrying case is adapted and dimensioned for receiving a pair of eyeglasses therein so that the width of the lens frame portion of the eyeglasses extends in a substantially axial direction in the capsule and the upper and lower extremities of the eyeglasses are disposed adjacent substantially diametrically opposite portions of the capsule. The first and second capsule sections preferably define opposite first and second end portions of the capsule, and the ends of the capsule are preferably formed in rounded configurations. Further, the capsule is preferably dimensioned so that when a pair of eyeglasses is received therein, the opposite ends of the lens frame portion of the eyeglasses are disposed adjacent the opposite ends of the capsule. Further, one end portion of the capsule is preferably made in an opaque construction, and the entire capsule is preferably constructed so that it is waterproof when the first and second capsule sections are releasably connected. The carrying case preferably further comprises a tubular element which extends through an interior section of one end portion thereof, and a carrying strap which extends through the tubular element for providing a convenient means for carrying the capsule without affecting the waterproof integrity thereof.

For use and operation of the carrying case of the instant invention, the first and second carrying case sections are disconnected, and a pair of eyeglasses is inserted into the interior of one of the sections. The carrying case sections are then reassembled so that the pair of eyeglasses is positioned inside of the assembled capsule. Because of the dimensions of the carrying case with respect to the eyeglasses, only the frames of the eyeglasses engage the inner walls of the capsule, and the lenses are protected so that they are not scratched or marred by the interior of the capsule. Further, because the carrying case is waterproof, it can be effectively used for transporting sunglasses and the like on various water vessels or at the beach. In this regard, normally, even if the carrying case falls into the water, it will float because of its hollow construction, notwithstanding the additional weight of a pair of glasses contained therein. Further, because one end portion of the capsule is preferably made in an opaque construction, the capsule can alo be utilized for containing various valuables, such as watches, keys, loose pocket change, etc. in addition to or instead of a pair of eyeglasses, and the valuable can be concealed in the opaque end portion of the case.

Accordingly, it is an object of the instant invention to provide an effective carrying case for a pair of eyeglasses.

Another object of the instant invention is to provide an effective carrying case for a pair of eyeglasses, wherein the carrying case is in the configuration of a cylindrical capsule.

A still further object of the instant invention is to provide an effective waterproof carrying case for a pair of eyeglasses, wherein the lenses of the eyeglasses are prevented from contacting the interior wall of the case.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention:

FIG. 1 is a perspective view of the eyeglasses case of the instant invention with a pair of eyeglasses received therein;

FIG. 2 is an exploded perspective view of the eyeglasses case; and

FIG. 3 is a sectional view taken along line 3—3 in FIG. 1.

DESCRIPTION OF THE INVENTION

Referring now to the drawing, the eyeglasses carrying case of the instant invention is illustrated in FIGS. 1–3 and generally indicated at 10. The eyeglasses case 10 comprises a capsule generally indicated at 12 which includes first and second capsule sections 14 and 16, and a carrying strap 18, and it is operable for receiving and containing a pair of eyeglasses, such as the eyeglasses generally indicated at 20, in a manner wherein the lenses of the eyeglasses 20 are effectively prevented from contacting the inner wall of the capsule 12.

The eyeglasses case 10 is adapted for use in combination with various types of eyeglasses, including sunglasses, of conventional construction. In this connection, the eyeglasses 20 comprise lenses 22, a bow or lens frame portion 24, and a pair of temples or side frame portions 26, which are hingeably attached to opposite ends of the lens frame portion 24. Accordingly, the eyeglasses 20 are alternatively positionable in a collapsed disposition wherein the temples 26 are positioned adjacent the lenses 22 and the lens frame portion 24 or an operative position wherein the temples 26 extend rearwardly from the lens frame portion 24.

The capsule 12 which preferably has a substantially cylindrical configuration is generally defined by the first and second capsule sections 14 and 16, respectively, and the capsule sections 14 and 16 are preferably formed with rounded ends 28 and 30, respectively. The first capsule section 14 is formed with female threads 32 adjacent the open end thereof, and the second capsule section 16 is formed with male threads 34 adjacent the open end thereof, and hence, the first and second capsule sections 14 and 16, respectively, are releasably connectable in threaded engagement to define the capsule 12. The capsule sections 14 and 16 are preferably further constructed so that when they are releasably connected in this manner, the capsule 12 defines a substantially waterproof interior chamber which provides sufficient buoyancy to enable the case 10 to float in water notwithstanding the weight of the eyeglasses 20. The first capsule section 14 is preferably constructed from a suitable plastic material in an opaque construction, whereas the second capsule section 16 is preferably constructed from a suitable plastic material in a transparent construction. Extending through the rounded end portion 30 of the capsule section 16 is a tubular element 36 which is open at the ends thereof, and which is preferably secured in the capsule section 30 in waterproof relation. The carrying strap 18 extends through the tubular element 36 for providing an effective means for carrying the case 10 when the capsule sections 14 and 16 are in assembled relation without affecting the waterproof integrity of the capsule 12.

The capsule 12 is preferably dimensioned for receiving and positioning the eyeglasses 20 therein in a manner wherein the lenses 20 are prevented from contacting the inner walls of the capsule sections 14 and 16. More specifically, the capsule 12 is preferably dimensioned for receiving the eyeglasses 20 so that the width (the side-to-side dimension when the eyeglasses 20 are worn by a wearer) of the lens frame portion 24 extends in a substantially axial direction in the capsule 12 as illustrated in FIG. 1, and preferably so that the opposite ends of the lens frame portion 24 are positioned within the opposite rounded ends 28 and 30 in order to prevent excessive longitudinal movement of the eyeglasses 20 in the capsule 12. The capsule 12 preferably has a substantially cylindrical configuration with a substantially circular cross section as illustrated in FIG. 3, and it is preferably further dimensioned so that when the eyeglasses 20 are received therein, the upper and lower extremities of the eyeglasses 20 are positioned adjacent substantially diametrically opposite portions of the capsule 12 in order to prevent excessive lateral movement of the eyeglasses 20 in the capsule 12. In this connection, since the capsule 12 is dimensioned so that the upper and lower extremities of the eyeglasses 20 are positioned adjacent substantially diametrically opposite portions of the capsule 12, it is virtually impossible for the lenses 22 to contact the inner wall of the capsule 12; and hence the lenses 22 are protected against scratching.

For use of the carrying case 10, the first and second casing sections 14 and 16, respectively, are disengaged from each other; and a pair of eyeglasses, such as the eyeglasses 20, is installed in one of the casing sections 14 or 16. The other casing section 14 or 16 is then assembled over the eyeglasses 20, and the two casing sections 14 and 16 are releasably connected by threadedly engaging the screw threads 34 in the screw threads 32. Once the pair of eyeglasses 20 has been received in the capsule 12 in this manner, it is effectively retained without significant longitudinal or lateral movement therein; and the lenses 22 are prevented from contacting the inner wall of the capsule 12 so that they are protected against scratching. Further, since the capsule 12 is waterproof, the casing 10 will normally float if it is dropped in the water so that it is effectively adapted for use on various types of watercraft as well as at the beach. The carrying strap 18 provides an effective means for carrying the capsule 12; and since the tubular element 36 is effectively sealed in the capsule 12, it does not interfere with the waterproof construction thereof. Still further, since the first capsule section 14 is opaque, various valuables, such as keys, jewelry, or currency can be stored and concealed in the capsule section 14 either along with the eyeglasses 20 or when the eyeglasses 20 are removed therefrom. Hence, it is seen that the carrying case of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A carrying case for a pair of eyeglasses comprising a substantially rigid cylindrical capsule comprising releasably connected first and second capsule sections, said capsule being adapted and dimensioned for receiving said pair of eyeglasses therein when said pair of eyeglasses is in a collapsed disposition and for positioning said pair of eyeglasses so that the width of the lens frame portion thereof extends in a substantially axial direction in said capsule and the upper and lower extremities of said pair of eyeglasses are disposed adjacent substantially diametrically opposite portions of said capsule.

2. In the carrying case of claim 1, said capsule further characterized as having rounded ends.

3. In the carrying case of claim 1, said first and second capsule sections further characterized as defining opposite end portions of said capsule.

4. In the carrying case of claim 2, said capsule further characterized as being dimensioned so that when said pair of eyeglasses is received therein, the opposite ends of the lens frame portion of said pair of eyeglasses are disposed adjacent opposite ends of said capsule.

5. In the carrying case of claim 1, one end portion of said capsule being opaque.

6. In the carrying case of claim 3, said first capsule section further characterized as being opaque.

7. In the carrying case of claim 1, said capsule further characterized as being waterproof when said first and second capsule sections are releasably connected.

8. The carrying case of claim 1 further comprising carrying strap means attached to said second capsule section.

9. In the carrying case of claim 8, said carrying strap means comprising a tubular element extending through an interior section of said capsule, the opposite ends of said tubular element communicating with the exterior of said capsule, and a strap element extending through said tubular element.

10. In the carrying case of claim 9, said capsule further characterized as being waterproof.

11. The carrying case of claim 1 in combination with a pair of eyeglasses releasably received in said capsule.

12. In combination, a pair of eyeglasses and a carrying case therefor, said carrying case comprising a substantially rigid cylindrical capsule comprising releasably connected first and second capsule sections, said capsule being adapted and dimensioned for receiving said pair of eyeglasses therein when said pair of eyeglasses is in a collapsed disposition and for positioning said pair of eyeglasses so that the width of the lens frame portion thereof extends in a substantially axial direction in said capsule and the upper and lower extremities of said pair of eyeglasses are disposed adjacent substantially diametrically opposite portions of said capsule.

* * * * *